US011001344B2

(12) United States Patent
Cho

(10) Patent No.: US 11,001,344 B2
(45) Date of Patent: May 11, 2021

(54) MOORING APPARATUS

(71) Applicant: Beong Ho Cho, Seongnam-si (KR)

(72) Inventor: Beong Ho Cho, Seongnam-si (KR)

( * ) Notice: Subject to any disclaimer, the term of this patent is extended or adjusted under 35 U.S.C. 154(b) by 295 days.

(21) Appl. No.: 16/320,171

(22) PCT Filed: Jul. 25, 2017

(86) PCT No.: PCT/KR2017/008014
§ 371 (c)(1),
(2) Date: Jan. 24, 2019

(87) PCT Pub. No.: WO2018/021807
PCT Pub. Date: Feb. 1, 2018

(65) Prior Publication Data

US 2020/0223514 A1 Jul. 16, 2020

(30) Foreign Application Priority Data

Jul. 27, 2016 (KR) ..... 10-2016-0095656
Jul. 27, 2016 (KR) ..... 10-2016-0095661

(51) Int. Cl.
*B63B 21/26* (2006.01)
*B63B 21/50* (2006.01)
*B63B 35/44* (2006.01)

(52) U.S. Cl.
CPC ..... *B63B 21/26* (2013.01); *B63B 21/50* (2013.01); *B63B 35/4413* (2013.01)

(58) Field of Classification Search
CPC ..... B63B 21/26; B63B 21/50; B63B 35/4413
See application file for complete search history.

(56) References Cited

U.S. PATENT DOCUMENTS 3,170,433 A * 2/1965 Gardiner ..... F42B 12/68 114/295
6,106,199 A * 8/2000 Medeiros, Jr. ..... B63B 21/22 405/224
6,895,884 B1 5/2005 Velázquez
2003/0029620 A1* 2/2003 Strand ..... E21B 41/0007 166/367
2009/0129871 A1* 5/2009 Mohr ..... E02D 13/00 405/232

FOREIGN PATENT DOCUMENTS

JP S61-049029 A 3/1986
JP S61-206735 U 12/1986
JP S62-202116 A 9/1987
JP S63-155797 U 10/1988
JP H09-290798 A 11/1997
JP H10-169351 A 6/1998
(Continued)

*Primary Examiner* — Tara Mayo-Pinnock
(74) *Attorney, Agent, or Firm* — Paratus Law Group, PLLC

(57) ABSTRACT

A mooring apparatus includes a housing positioned on a seabed by being lowered from a hull, a driven pile inserted into a first through hole formed in the housing, configured to come out of the housing on the seabed, and embedded in and fixed to the seabed, and an anchor line configured to come out of a guide hole formed in the driven pile when the driven pile is embedded in and fixed to the seabed and moving downward through the seabed so as to reinforce a supporting force of the driven pile.

14 Claims, 13 Drawing Sheets

(56) References Cited

FOREIGN PATENT DOCUMENTS

| | | | |
|---|---|---|---|
| JP | 2000-016382 | A | 1/2000 |
| JP | 2011-196023 | A | 10/2011 |
| KR | 10-1177396 | B1 | 8/2012 |
| KR | 20-2015-0002910 | U | 7/2015 |
| KR | 10-2016-0059007 | A | 5/2016 |

* cited by examiner

MOORING APPARATUS

CROSS REFERENCE TO PRIOR APPLICATIONS

This application is a National Stage Patent Application of PCT International Patent Application No. PCT/KR2017/008014 filed on Jul. 25, 2017 under 35 U.S.C. § 371, which claims priority to Korean Patent Application Nos. 10-2016-0095656 filed on Jul. 27, 2016 and 10-2016-0095661 filed on Jul. 27, 2016, which are all hereby incorporated by reference in their entirety.

BACKGROUND

1. Field of the Invention

The present disclosure relates to a mooring apparatus, and more specifically, to a mooring apparatus for quickly and stably fixing a driven pile to the seabed.

2. Discussion of Related Art

Generally, a semi-submersible offshore structure is known as a structure for work at sea such as drilling. The semi-submersible offshore structure has an advantage of being used and operated even in the extreme environments in the sea due to moving relatively less in a vertical direction.

The semi-submersible offshore structure is moored by a mooring line so as to not be moved due to ocean wave, tidal current, or tide. The mooring line is provided to connect an offshore structure positioned on a surface of the sea with a pile installed on the seabed to be inclined, and thus a vertical load applied to the mooring line may be applied to the pile.

When a large load is applied to the mooring line according to various marine environments and working conditions, such as ocean wave, tidal current, tide, a size of a marine structure and the like, magnitude of load applied to the pile in a vertical direction also increases. The vertical load may cause micro motion to the pile member, and particularly, when a large load, such as temporary impact, is generated, a force greater than a soil adhesive friction force is generated in a vertical direction, and thus a pile embedded in the seabed may be moved upward.

Once the pile is moved upward from the seabed, since the pile does not have a force to be lowered to the ground, the pile stays at the upwardly moved position, and when the pile is repeatedly moved upward and stays, the pile finally loses a supporting force, and thus an accident occurs in which the pile is pulled out from the seabed.

In this case, the structure breaks away from a correct position, and thus problems of degrading efficiency of marine works, causing a great deal of work, and excessive time and costs for reinstalling a mooring apparatus are caused.

SUMMARY

One aspect of the present disclosure provides a mooring apparatus comprising a housing positioned on a seabed by being lowered from a hull, a driven pile inserted into a first through hole formed in the housing, configured to come out of the housing when the housing is positioned on the seabed, and embedded in and fixed to the seabed, and an anchor line configured to come out of the guide hole formed in the driven pile and move through the seabed when the driven pile is embedded in and fixed to the seabed.

Another aspect of the present disclosure provides a mooring apparatus comprising a first housing positioned on a seabed by being lowered from a hull, a second housing coupled to an upper portion of the first housing to be vertically movable, a driven pile inserted into the first through hole formed in the first housing and embedded in and fixed to the seabed when the first housing is positioned on the seabed, and an actuator installed in the second housing to be positioned directly above the driven pile and configured to press an upper portion of the driven pile.

When the housing is lowered from a hull and is positioned on the seabed, an actuator presses a driven pile inserted into a housing and fixes the driven pile to the seabed, and thus the mooring apparatus according to the present disclosure can allow the driven pile to be quickly installed.

Further, an anchor line connected with the driven pile spreads radially through the seabed, and the driven pile is tightly pulled in the seabed, and thus the mooring apparatus according to the present disclosure can allow the driven pile to be firmly fixed to the seabed.

DETAILED DESCRIPTION

Figure 1:
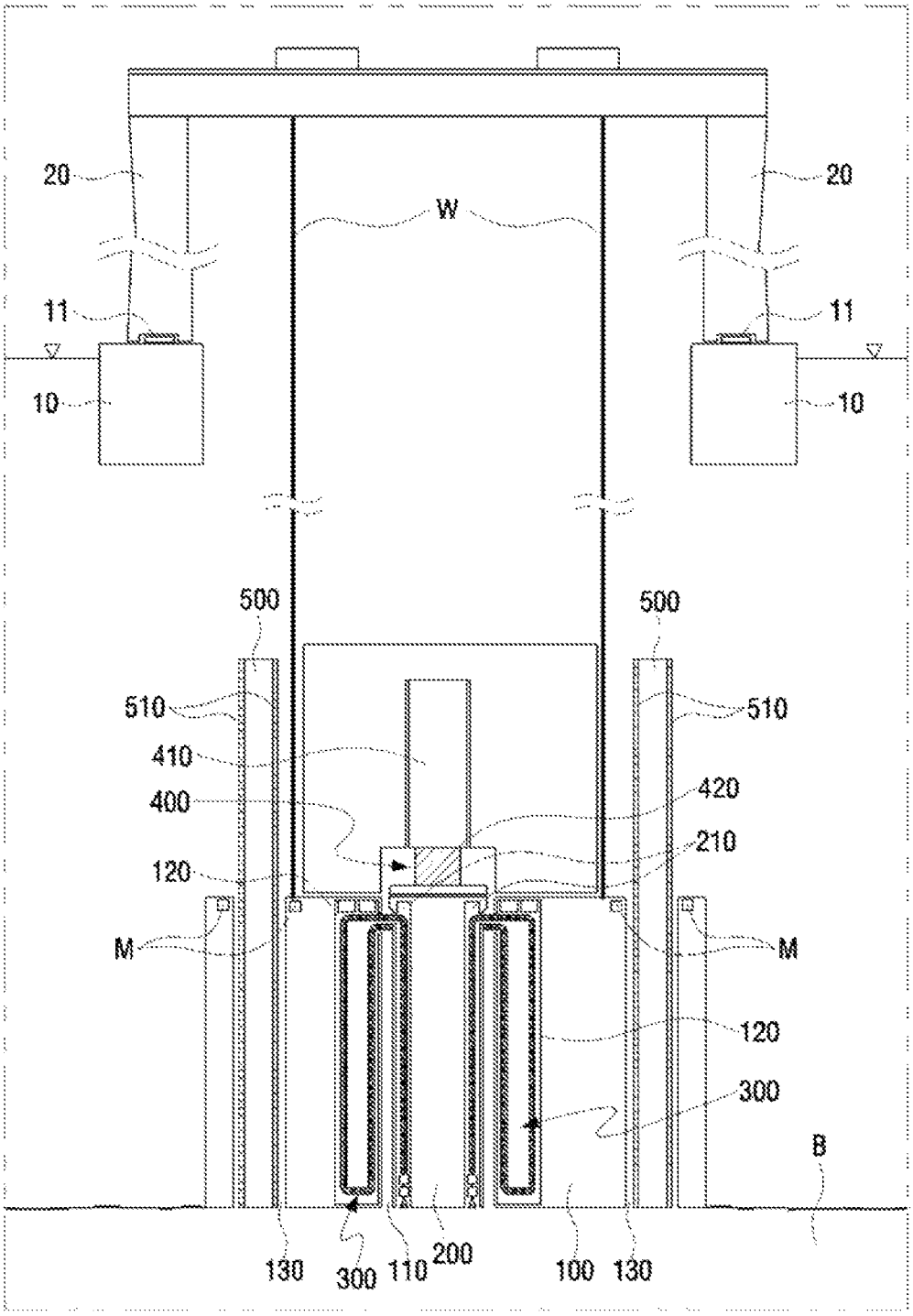
FIG. 1 is a view showing an overall structure of a mooring apparatus according to a first embodiment of the present disclosure.

Hereinafter, exemplary embodiments of the present disclosure will be described in detail with reference to the accompanying drawings. It should be noted that, when reference numerals are assigned to components of each drawing in this specification and the same components are illustrated in different drawings, the same numerals will be assigned to the same components whenever possible. When describing the present disclosure, detailed descriptions of related well-known techniques that are deemed to unnecessarily obscure the gist of the present disclosure will be omitted.

FIG. 1 is a view showing an overall structure of a mooring apparatus according to a first embodiment of the present disclosure.

As shown in FIG. 1, the mooring apparatus according to the first embodiment of the present disclosure comprises a housing 100, a driven pile 200, and an anchor line 300.

When a hull 10 for collecting a material, such as crude oil, natural gas, and the like, arrives at a position at which a marine structure, such as floating production storage and offloading plant (FPSO), floating liquid natural gas plant, or the like, is moored, the housing 100 is lowered from the hull 10 and positioned on a seabed B.

To this end, a gantry crane 20 is installed in the hull 10. The gantry crane 20 is connected with the housing 100 by a wire W so as to lower the housing 100 to the seabed B by unwinding the wire W when the hull 10 arrives at a predetermined position.

Further, when an operation for fixing the driven pile 200 described below to the seabed B is completed, the gantry crane 20 rewinds the wire W to return the housing 100 to the hull 10. The gantry crane 20 may be coupled to a pair of rails 11 installed on an upper surface of the hull 10 to be slidably moved and is horizontally moved on the upper surface of the hull 10.

The driven pile 200 is inserted into a first through hole 110 formed in the housing 100. An operation of inserting the driven pile 200 into the first through hole 110 may be performed after the hull 10 arrives at a position at which the marine structure is moored. That is, when the hull 10 arrives at a position at which the marine structure is moored, the driven pile 200 accommodated on the hull 10 is moved upward by the crane and the like and may be inserted into the first through hole 110.

As described above, when the housing 100 is positioned on the seabed B by the gantry crane 20, the driven pile 200 comes out of the housing 100 and is embedded in and fixed to the seabed B.

An actuator 400 is installed directly above the driven pile 200 in the housing 100 and presses an upper portion of the driven pile 200 positioned on the seabed B so as to allow the driven pile 200 to be embedded in and fixed to the seabed B.

Figure 2:
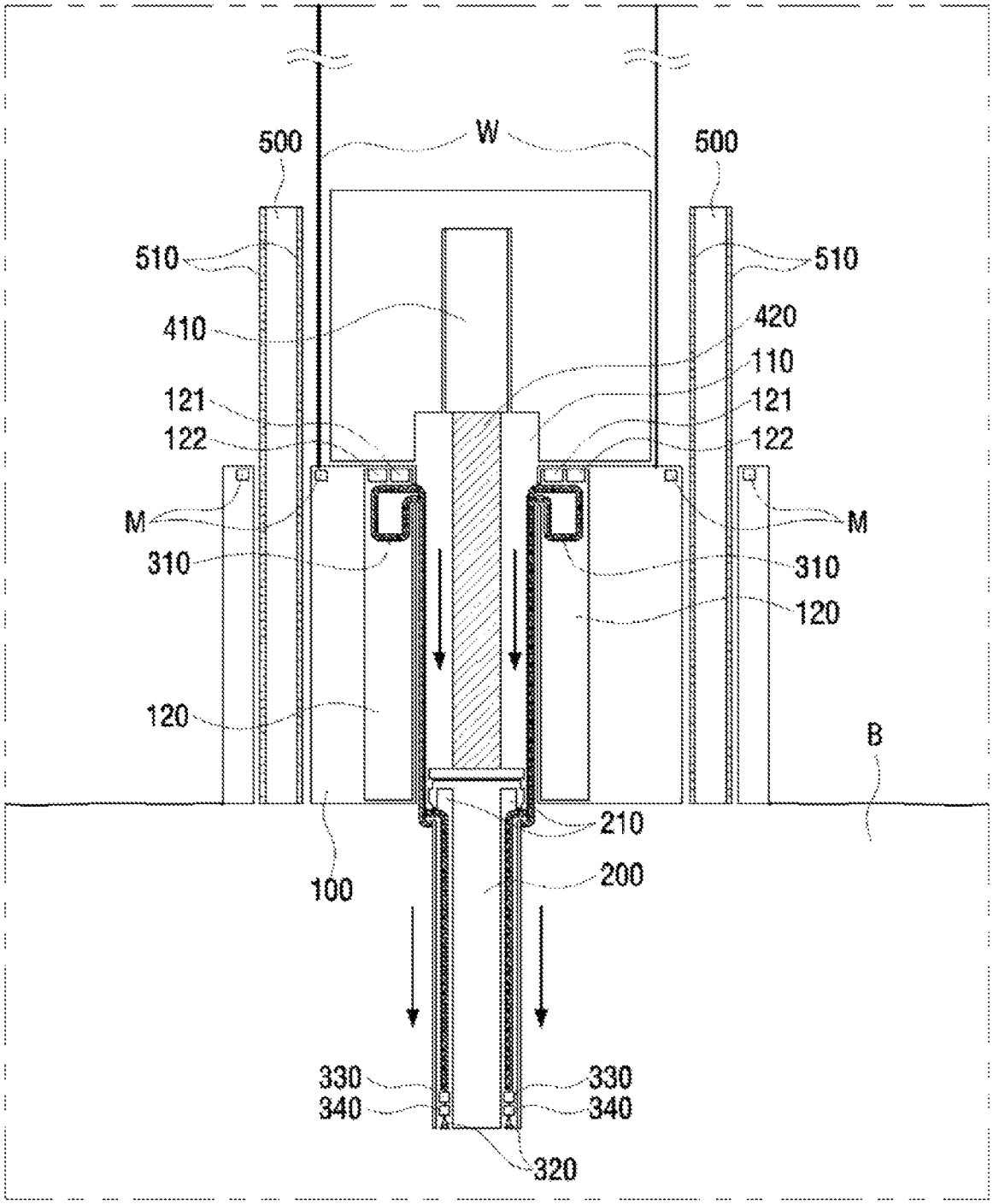
FIG. 2 is a view showing a state in which an actuator according to the first embodiment of the present disclosure presses an upper portion of a driven pile.

FIG. 2 is a view showing a state in which an actuator according to the first embodiment of the present disclosure presses an upper portion of a driven pile.

Specifically, when the wire W is unwound by the gantry crane 20 so that the driven pile 200 and the housing 100 are positioned on the seabed B, as shown in FIG. 2, the actuator 400 presses the upper portion of the driven pile 200 vertically downward so as to embed and fix the driven pile 200 to the seabed B.

The actuator 400 comprises a cylinder 410 installed in the housing 100 and a slider 420 vertically moving downward from the cylinder 410 to press an upper portion of the driven pile 200. A structure of the actuator 400 is not limited thereto, and various devices, such as a hydraulic hammer and the like, may be used.

Figure 3:
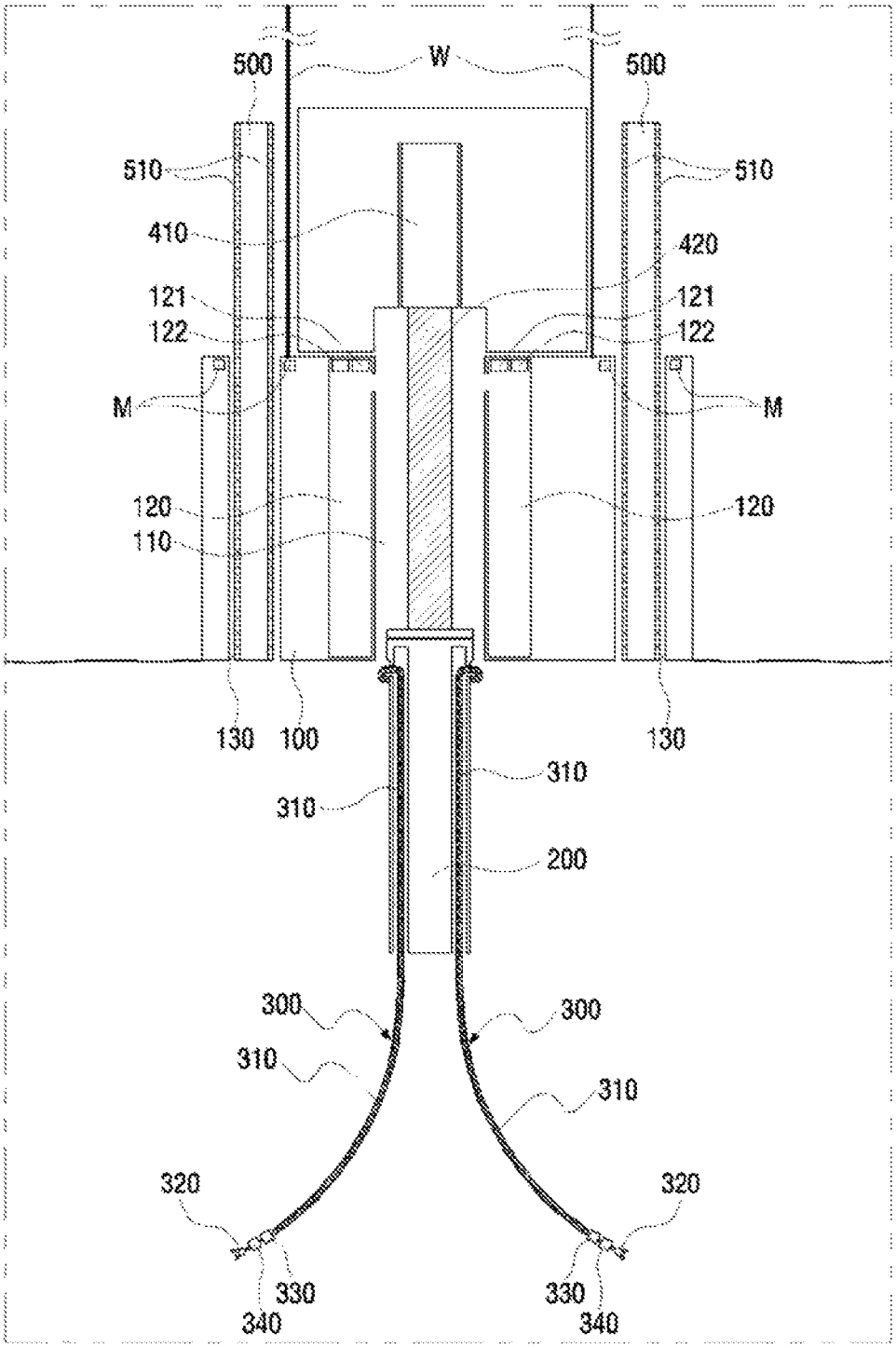
FIG. 3 is a view showing a state in which an anchor line according to the first embodiment of the present disclosure spreads radially through the seabed.

FIG. 3 is a view showing a state in which an anchor line according to the first embodiment of the present disclosure spreads radially through the seabed.

As described above, when the driven pile 200 is embedded in and fixed to the seabed B by the actuator 400, as shown in FIG. 3, the anchor line 300 comes out of a guide hole 210 formed in the driven pile 200 (see FIGS. 1 and 2) and spreads radially through the seabed. In this case, the anchor line 300 moves through the seabed while being connected with the driven pile 200, and thus the driven pile 200 is tightly pulled by the anchor line 300 to be firmly fixed to the seabed B when the anchor line 300 is completely moved.

Although the driven pile 200 is embedded in the seabed B by the actuator 400 at a depth of tens of meters, when a load of tens of thousands of tons of the marine structure is continuously applied to the driven pile 200 through a mooring line connecting the driven pile 200 with the marine structure, and particularly, when a vertical load is continuously applied to the driven pile 200 while the marine structure sways with tidal current and the like, a problem in which the driven pile 200 is pulled out from the seabed B may be caused. Therefore, the anchor line 300 spreading radially through the seabed while being connected with the driven pile 200 embedded in the seabed B to be pulled from the inside of the seabed is additionally installed, and thus an accident in which the driven pile 200 is pulled out from the seabed B may be prevented.

The anchor line 300 may be accommodated in the driven pile 200, but the anchor line 300 has a length of at least several tens of meters, and thus it is difficult for the anchor line 300 to be accommodated in the driven pile 200. Therefore, as shown in FIG. 1, one end of the anchor line 300 is connected with the driven pile 200, and the other end thereof is accommodated in a chamber 120 formed in the housing 100 while being positioned in the guide hole 210.

In this case, as shown in FIG. 2, when the driven pile 200 is embedded in the seabed B by the actuator 400, that is, when the driven pile 200 is vertically lowered in the first through hole 110, a part of the anchor line 300 slowly comes out of the chamber 120 and is positioned in the through hole 110. Further, as shown in FIG. 3, when the driven pile 200 is completely embedded in and fixed to the seabed B, and then when the other part thereof comes out along the guide hole 210 and spreads radially through the seabed, the portion remaining in the chamber 120 comes out of the chamber 120.

Figure 4:
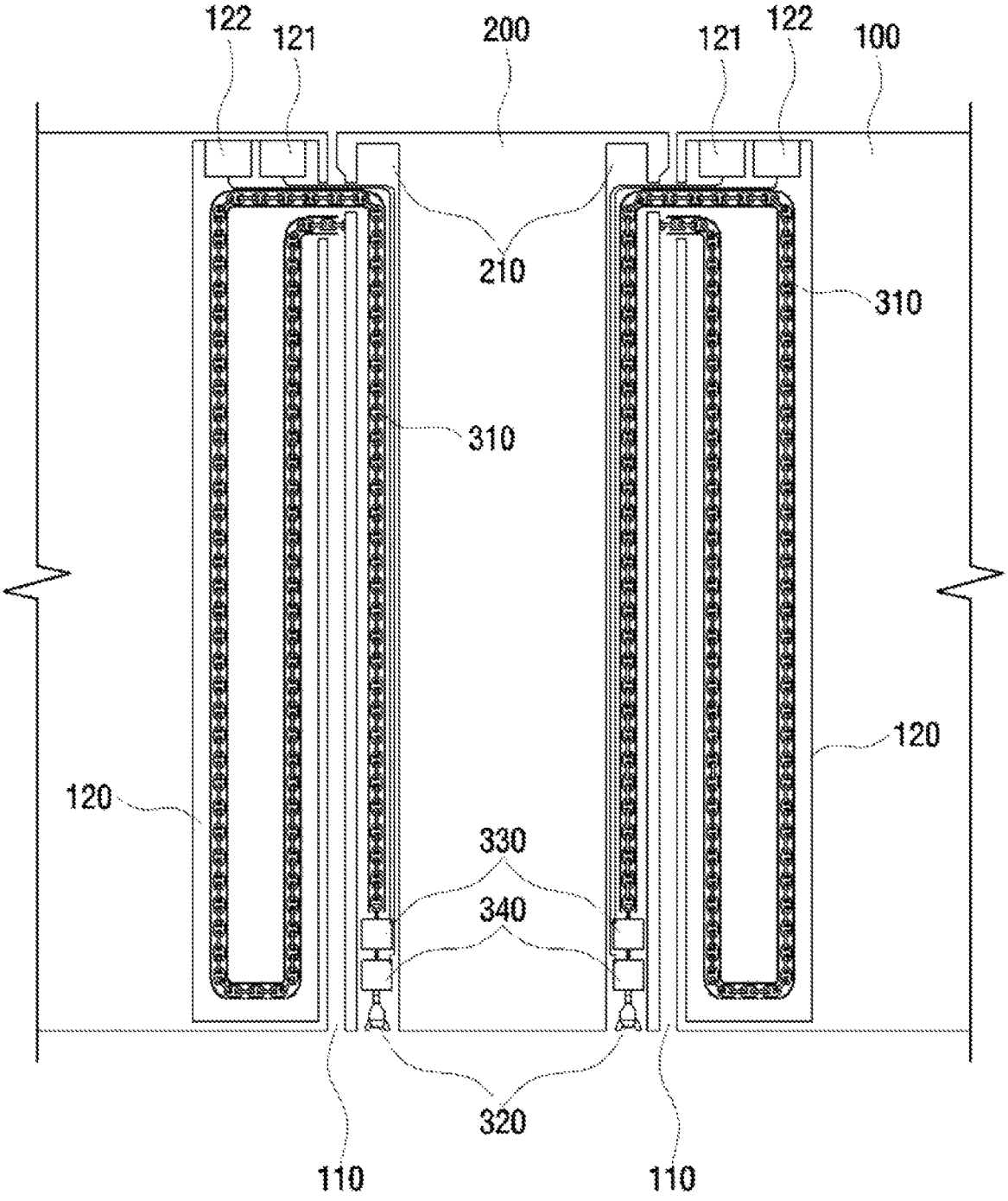
FIG. 4 is a view showing a structure of the anchor line according to the first embodiment of the present disclosure in more detail.

FIG. 4 is a view showing a structure of the anchor line according to the first embodiment of the present disclosure in more detail.

As shown in FIG. 4, the anchor line 300 includes a chain 310 having one end connected with the driven pile 200 and the other end positioned in the guide hole 210 while being accommodated in the chamber 120, a drill bit 320 installed on the other end of the chain 310 and moving the other end of the chain 310 deep down into the seabed, and a driving motor 340 for rotating the drill bit 320. In this case, the chain 310 is covered with a tube and the like so as to not be damaged while moving, and a power supply device 121 for supplying power to the driving motor 340 is installed in the chamber 120. The power supply device 121 is connected with the driving motor 340 through a power line.

Figure 5:
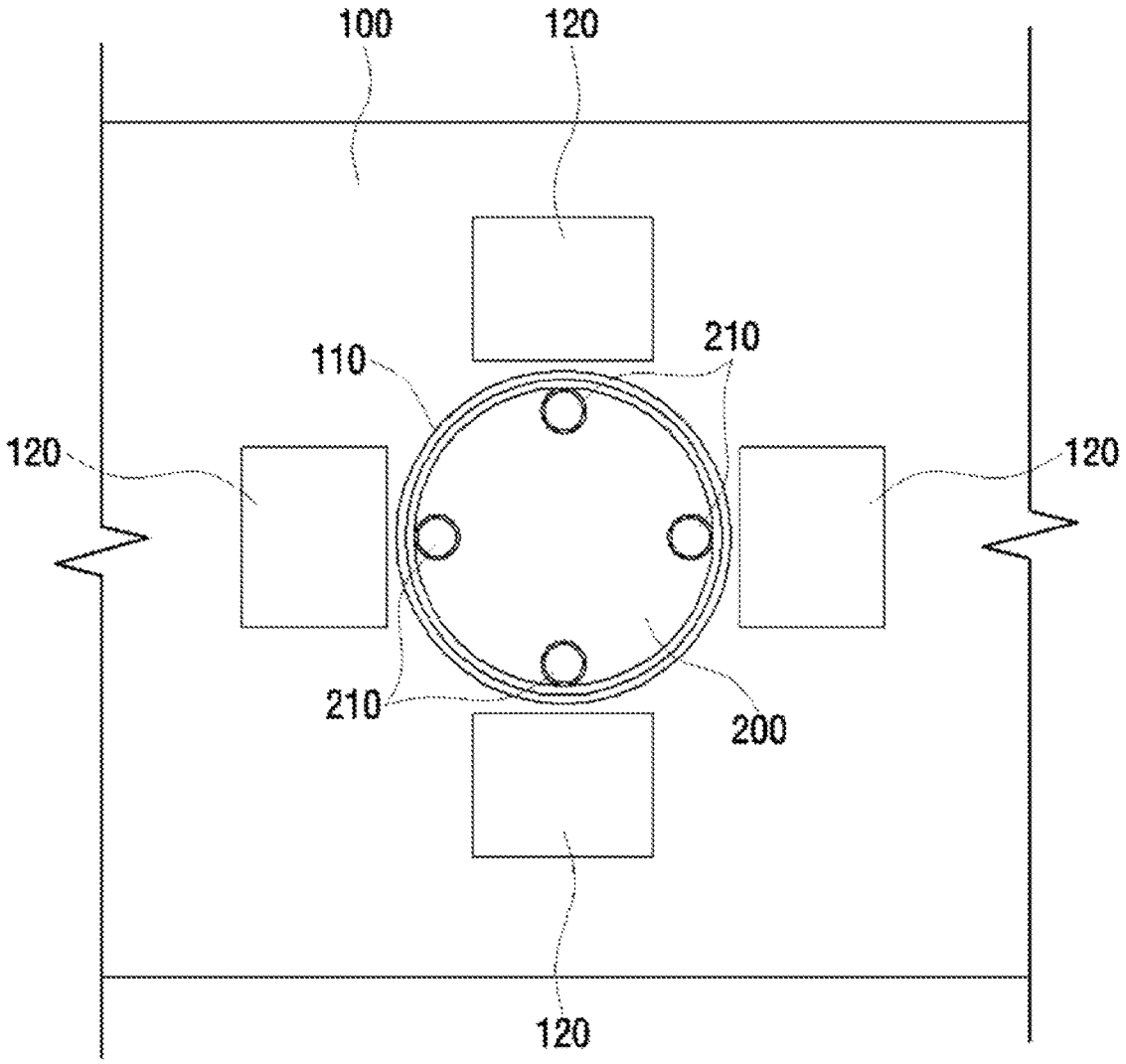
FIG. 5 is a cross-sectional view showing an internal structure of a housing and the driven pile according to the first embodiment of the present disclosure.

FIG. 5 is a cross-sectional view showing an internal structure of a housing and the driven pile according to the first embodiment of the present disclosure.

In this case, the four anchor lines 300 are installed to stably hold the driven pile 200. As shown in FIG. 5, the four chambers 120 in which the anchor lines 300 are accommodated are each formed in the housing 100, and four guide holes through which each of the anchor lines 300 passes are formed in the driven pile 200.

Figure 6:
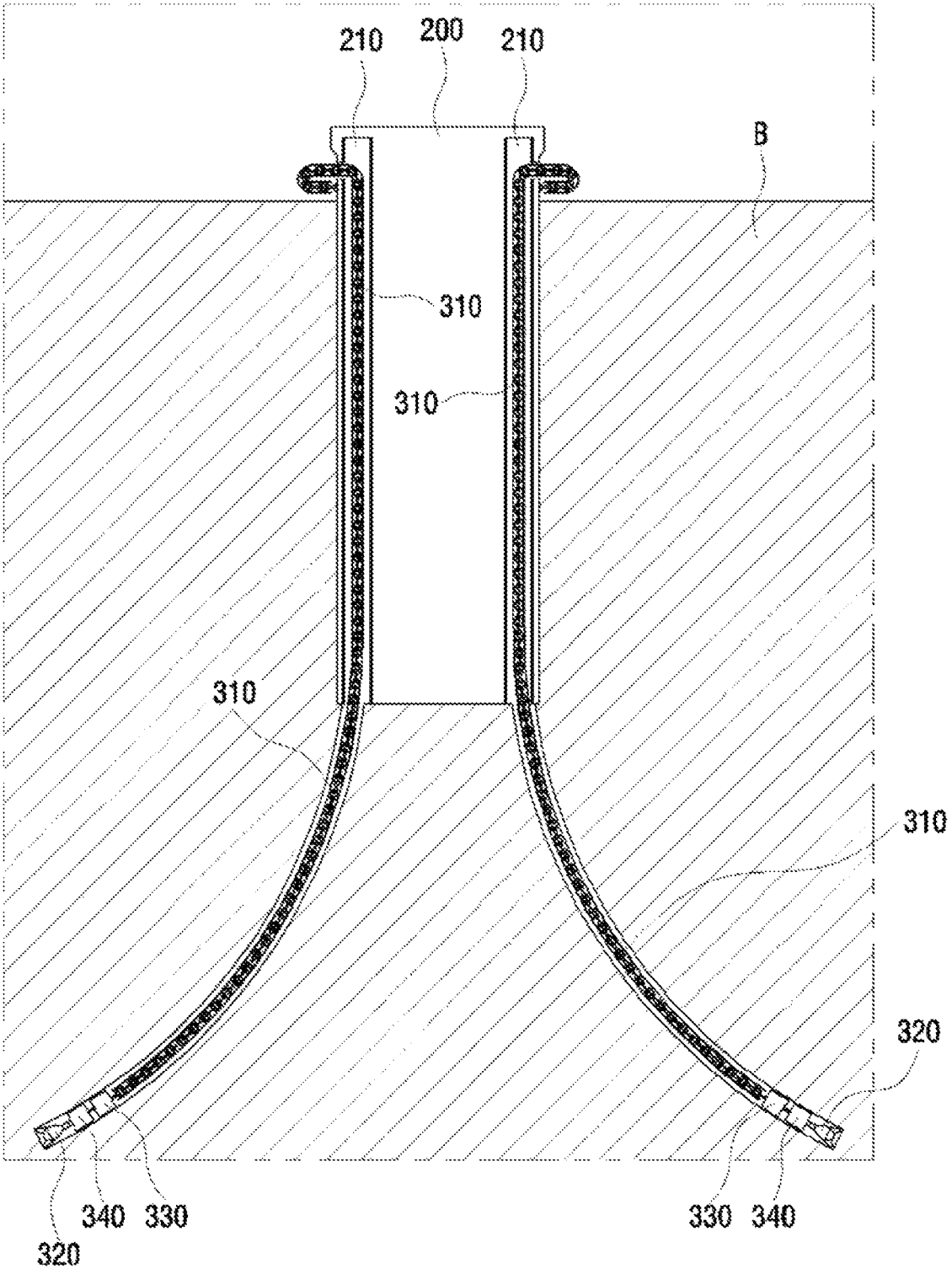
FIG. 6 is a view showing a state in which the driven pile according to the first embodiment of the present disclosure is fixed to the seabed by the anchor line in more detail.

FIG. 6 is a view showing a state in which the driven pile according to the first embodiment of the present disclosure is fixed to the seabed by the anchor line in more detail.

Therefore, when movement of the drill bit 320 is completed, as shown in FIG. 6, one end of the chain 310 spreads radially while being connected with the driven pile 200 to tightly pull the driven pile 200, and thus the driven pile 200 is firmly fixed to the seabed B.

Meanwhile, the anchor line 300 further comprises an anchor pack 330 installed on a rear portion of the drill bit 320 and filled with a hardening material when the drill bit 320 is completely moved.

When the anchor pack 330 is filled with the hardening material, such as cement or the like, the anchor pack 330 expands to close a hole formed in the seabed by the drill bit 320. Therefore, in the state of FIG. 6, when the anchor pack 330 is filled with the hardening material, the chain 310 connected with the driven pile 220 does not come out to the outside through the hole, that is, the chain 310 is completely fixed to the seabed, and thus the driven pile 200 is more firmly fixed to the seabed B.

A storage tank 122 is installed in the chamber 120 to supply the hardening material to the anchor pack 330 (see FIG. 4). The storage tank 122 stores the hardening material and supplies the hardening material to the anchor pack 330 through a supply tube connecting the anchor pack 330 with the storage tank 122 when the drill bit 320 is completely moved.

Meanwhile, as shown in FIG. 1, a plurality of second through holes 130 are formed in an outer circumferential portion of the housing 100, and legs 500 are formed in the second through holes 130 to be vertically movable.

When the housing 100 is positioned on the seabed B, the legs 500 vertically move along the inside of the second through holes 130 to adjust a height of the housing 100, and thus the housing 100 remains horizontal on the seabed B.

When the housing 100 remains horizontal using the legs 500 on the seabed B, as described above, a pressure applied by the actuator 400 is accurately applied to the driven pile 200, and thus an operation of embedding and fixing the driven pile 200 to the seabed B can be more quickly and stably performed.

A guide protrusion 510 protrudes from an outer surface of the leg 500 in a longitudinal direction, and a motor M is installed on an outer circumferential portion of the housing 100 to vertically move the guide protrusion 510. Therefore, the leg 500 is vertically moved when the motor M vertically moves the guide protrusion 510.

When the operation of installing the driven pile 200 performed on the seabed B is completed, as described above, the housing 100 is returned to the hull 10 by the gantry crane 20, and thus, only the driven pile 200 is embedded in the seabed B as shown in FIG. 6.

In this case, the supply tube for connecting the anchor pack 330 with the storage tank 122 and the power line for connecting the driving motor 340 with the power supply device 121 are separated from the anchor pack 330 and the driving motor 340 so as to be returned with the housing 100.

A mooring apparatus according to a second embodiment of the present disclosure will be described below with reference to the drawings. The same elements as those of the above-described first embodiment will be denoted with the same reference numerals.

Figure 7:
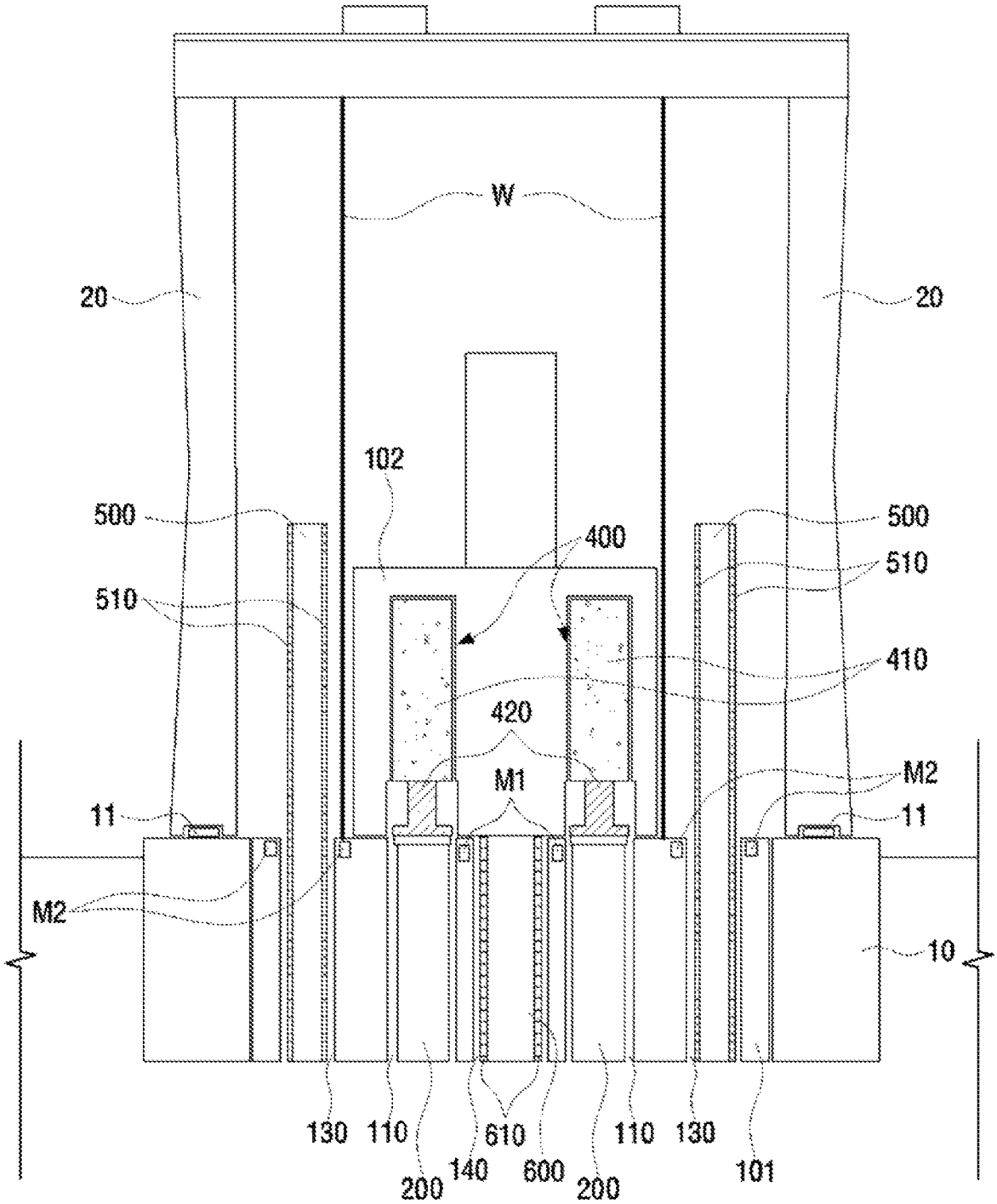
FIG. 7 is a view showing a state in which a mooring apparatus according to a second embodiment of the present disclosure is positioned on a hull.
Figure 8:
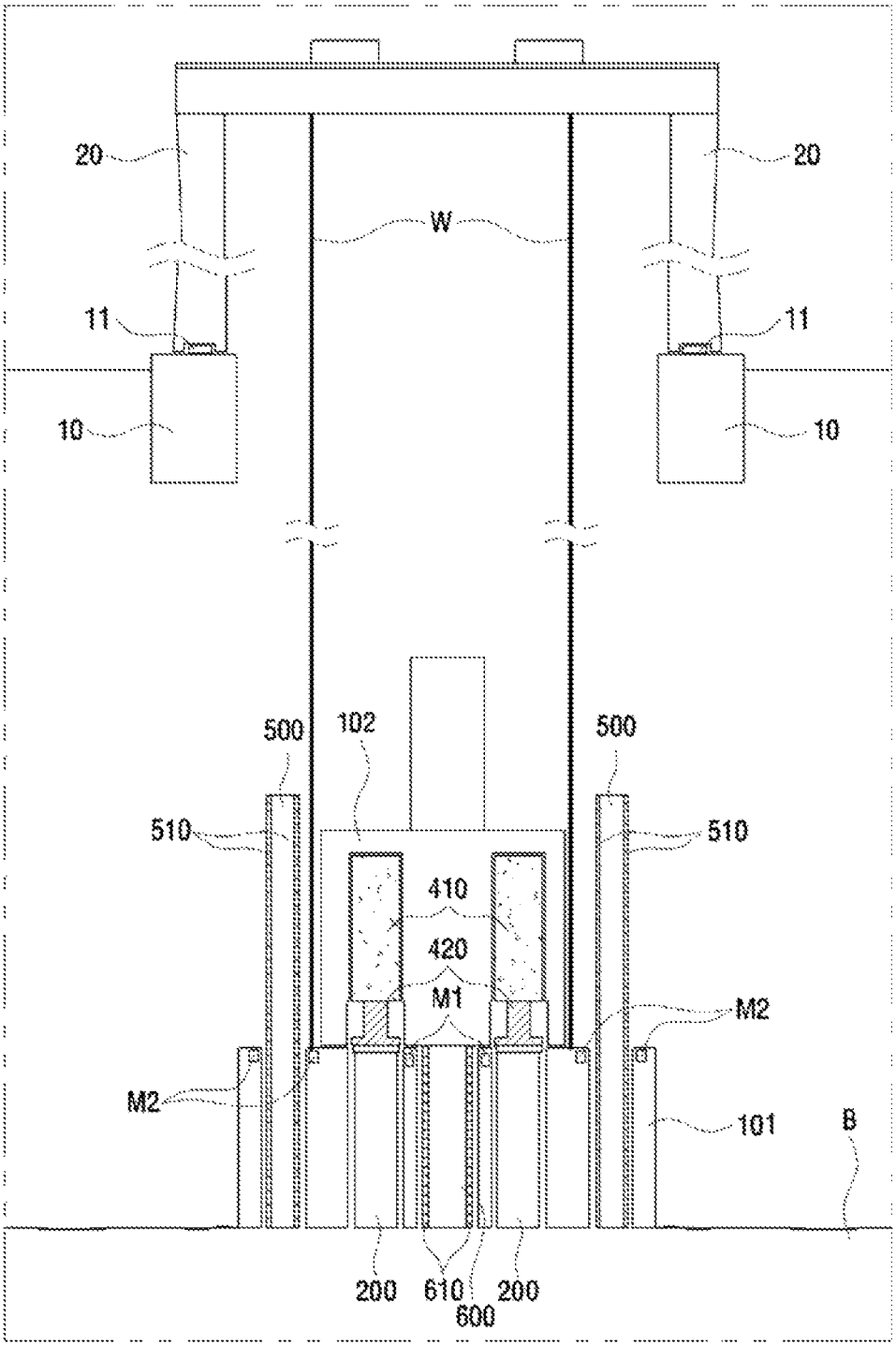
FIG. 8 is a view showing a state in which the mooring apparatus according to the second embodiment of the present disclosure is positioned on the seabed.

FIG. 7 is a view showing a state in which the mooring apparatus according to the second embodiment of the present disclosure is positioned on a hull, and FIG. 8 is a view showing a state in which the mooring apparatus according to the second embodiment of the present disclosure is positioned on the seabed.

As shown in FIGS. 7 and 8, the mooring apparatus according to the second embodiment of the present disclosure comprises a first housing 101, a second housing 102, a driven pile 200, and an actuator 400.

When a hull 10 for collecting a material, such as crude oil, natural gas, or the like, arrives at a position at which a marine structure, such as FPSO, floating liquid natural gas plant and the like, is moored, a first housing 101 is lowered from the hull 10 and is positioned on the seabed B, as shown in FIG. 8.

In the same manner as the housing 100 of the first embodiment, the first housing 101 is lowered to the seabed B by the gantry crane 20 installed in the hull 10 and is returned to the hull 10 when an operation of fixing the driven pile 200 to the seabed B is completed.

The second housing 102 is coupled to an upper side of the first housing 101, lowered to the seabed B along with the first housing 101 by the above-described gantry crane 20, and returned to the hull 10 along with the first housing 101 when an operation of fixing the driven pile 200 to the seabed B is completed.

The second housing 102 is installed on an upper side of the first housing 101 to be vertically movable. A third through hole 140 is formed in the center of the first housing 101, and a lifting shaft 600 is installed in the third through hole 140 so that an upper end thereof is coupled to the second housing 102.

The lifting shaft 600 is vertically moved along the third through hole 140 by a first motor M1 installed in the center of the first housing 101 and allows the second housing 102 to move upward and downward.

Figure 9:
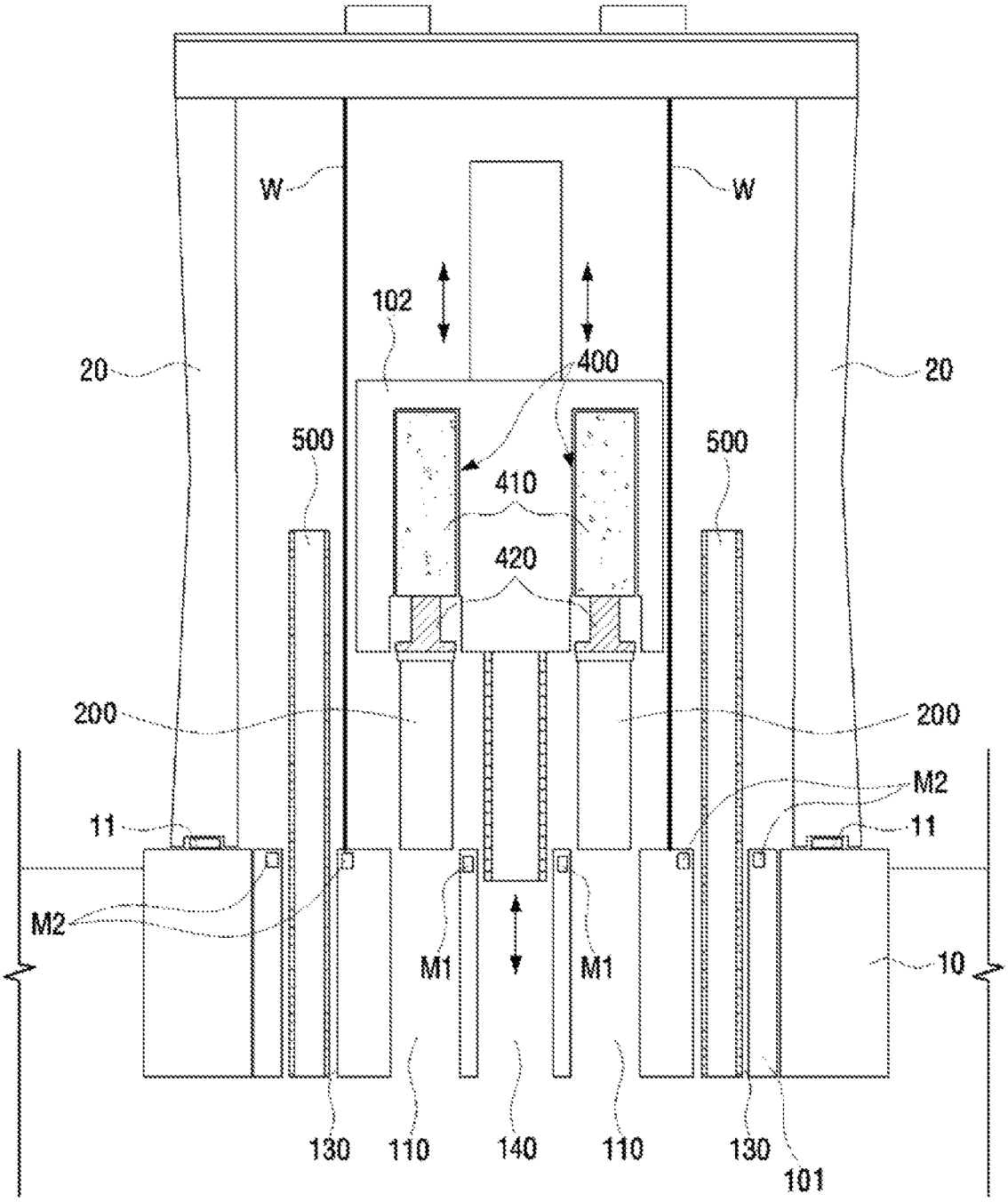
FIG. 9 is a view showing a state in which a second housing is moved upward by a lifting shaft according to the second embodiment of the present disclosure.
Figure 10:
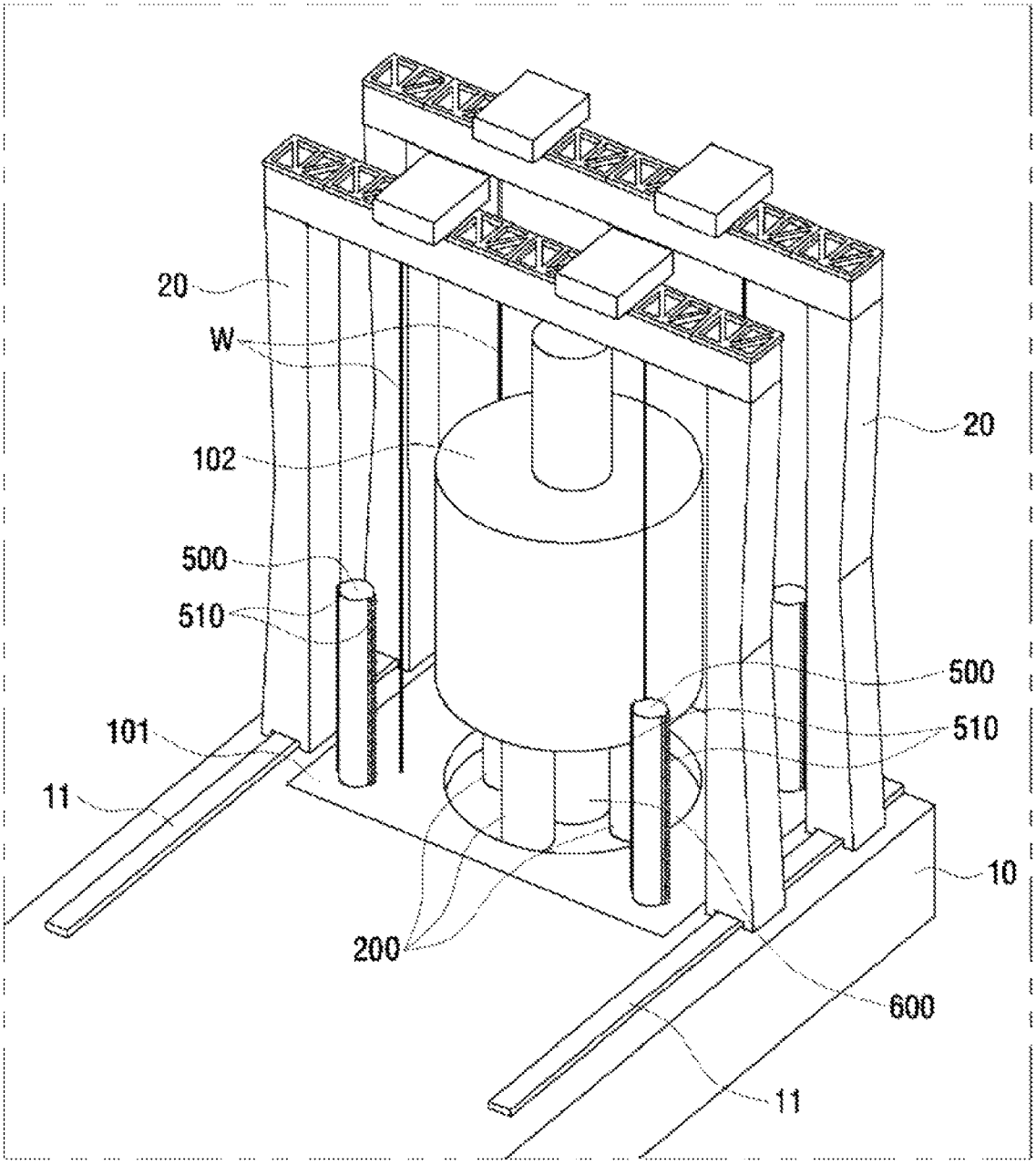
FIG. 10 is a view showing a state in which a second housing is moved upward by a lifting shaft according to the second embodiment of the present disclosure.

FIGS. 9 and 10 are views showing a state in which a second housing is moved upward by a lifting shaft according to the second embodiment of the present disclosure.

Specifically, as shown in FIGS. 9 and 10, the lifting shaft 600 is vertically moved upward along the third through hole 140 by the first motor M1 to move the second housing 102 upward or, as shown in FIG. 7, is vertically moved downward along the third through hole 140 to move the second housing 102 downward. In this case, when the second housing 102 is moved upward by the lifting shaft 600, the second housing 102 is separated from the first housing 101, or conversely, the second housing 102 is coupled to an upper portion of the first housing 101, as shown in FIG. 7.

Figure 11:
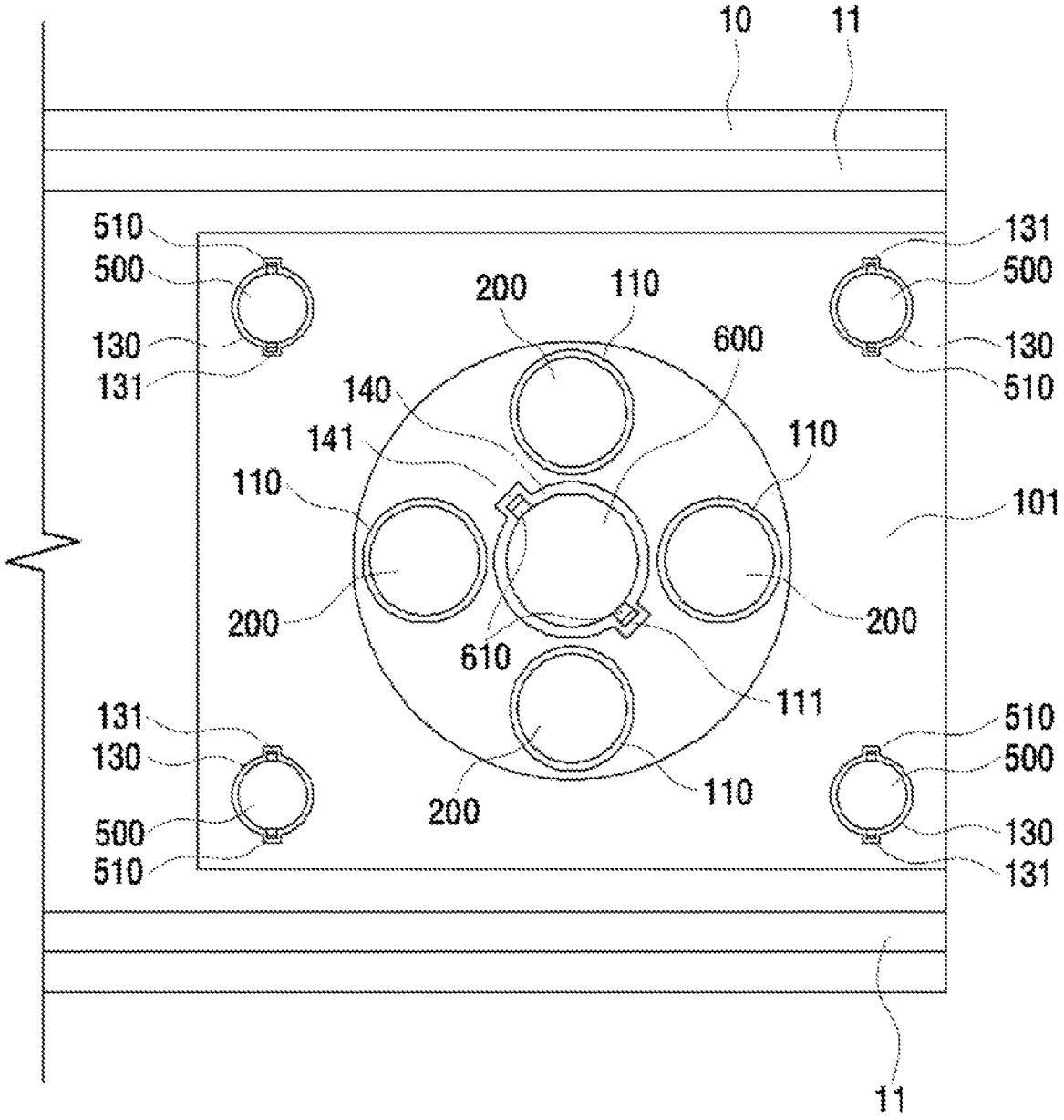
FIG. 11 is a cross-sectional view schematically showing an internal structure of the mooring apparatus according to the second embodiment of the present disclosure.

FIG. 11 is a cross-sectional view schematically showing an internal structure of the mooring apparatus according to the second embodiment of the present disclosure.

A first guide protrusion 610 protrudes from an outer surface of the lifting shaft 600 in a longitudinal direction, and as shown in FIG. 11, a first guide groove 141 is formed in the third through hole 140 into which the first guide protrusion 610 is inserted. In this case, when the lifting shaft 600 vertically moves along the third through hole 140, the first guide protrusion 610 moves along the first guide groove 141, and thus the lifting shaft 600 can be more stably moved in a vertical direction.

The driven pile 200 is inserted into the first through hole 110 formed in the first housing 101. A plurality of first through holes 110 may be formed in the first housing 101, and in this case, the driven piles 200 may be inserted into the plurality of first through holes 110. When the hull 10 arrives at a position at which the marine structure is moored, and when the lifting shaft 600 moves the second housing 102 upward as described above, an operation of inserting the driven pile 200 into the first through hole 110 is performed.

Specifically, as shown in FIGS. 9 and 10, when the lifting shaft 600 moves the second housing 102 upward so that the first through hole 110 formed in the first housing 101 is opened, the driven pile 200 accommodated on the hull 10 is moved to a gap between the first and second housings 100 and 200 by a worker and the like so that a lower end thereof is positioned in the first through hole 110. When the second housing 102 is lowered, an upper portion of the driven pile 200 is pressed by the second housing 102, and the driven pile 200 is inserted into the first through hole 110.

The actuator 400 is installed in the second housing 102 to be positioned directly above the driven pile 200, and as in the first embodiment, presses an upper portion of the driven pile 200 positioned on the seabed B to embed and fix the driven pile 200 to the seabed B.

In this case, the plurality of actuators 400 may be installed in the second housing 102 to simultaneously press the plurality of driven piles 200.

Figure 12:
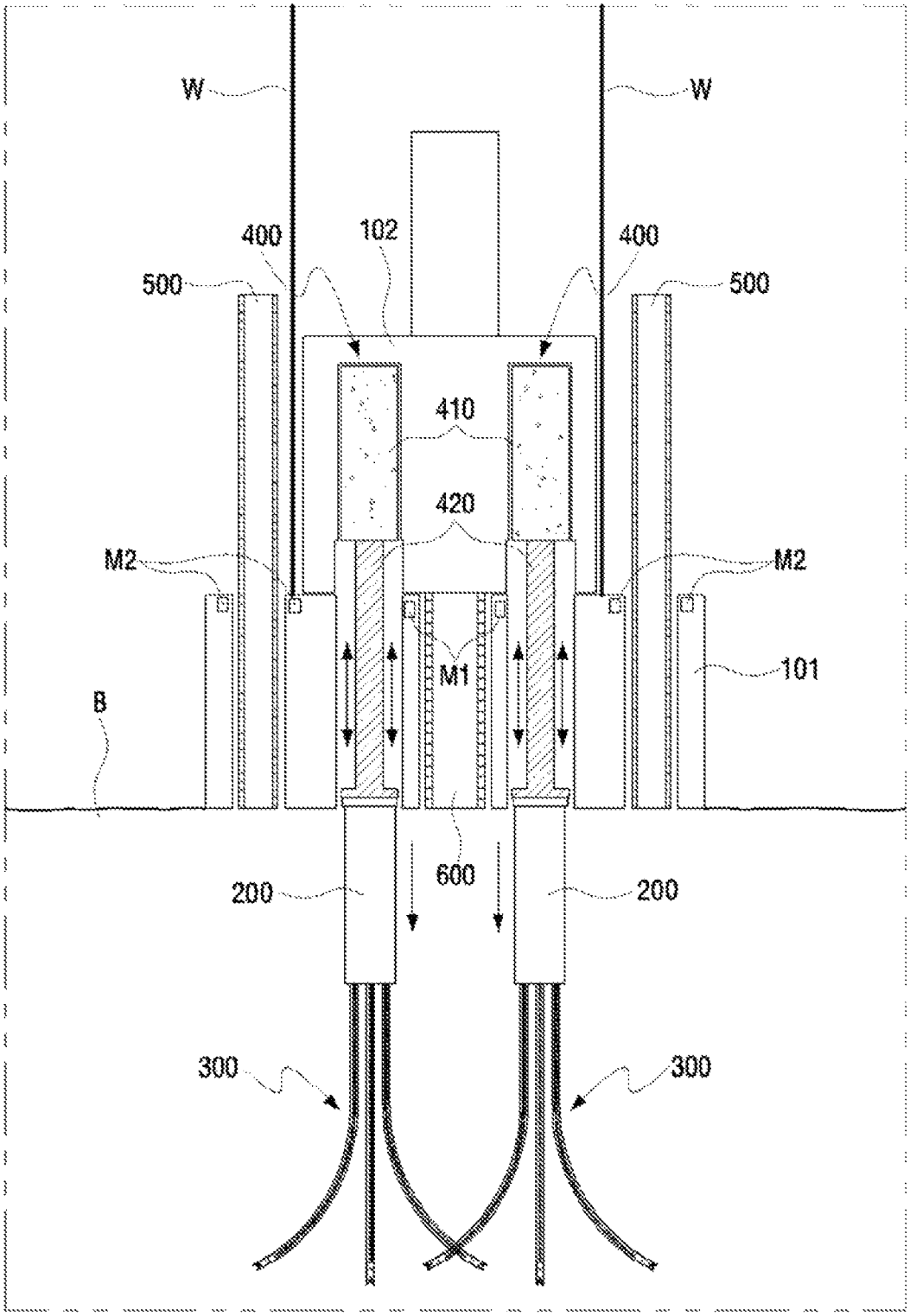
FIG. 12 is a view showing a state in which a driven pile according to the second embodiment of the present disclosure is embedded in and fixed to the seabed.

FIG. 12 is a view showing a state in which the driven pile according to the second embodiment of the present disclosure is embedded in and fixed to the seabed.

In this case, as shown in FIG. 12, the plurality of actuators 400 may allow the plurality of driven piles 200 to be simultaneously embedded in and fixed to the seabed B.

As in the first embodiment, the actuator 400 may comprise a cylinder 410 fixedly installed in the second housing 102 and a slider 420 vertically moving downward from the cylinder 410 to press an upper portion of the driven pile 200.

Meanwhile, as in the first embodiment, a plurality of second through holes 130 are formed in an outer circumferential portion of the first housing 101, and legs 500 are installed in the second through holes 130 to be vertically movable.

As shown in FIG. 8, when the first housing 101 is positioned on the seabed B, the legs 500 are vertically moved along the second through holes 130 by a second motor M2 installed on the outer circumferential portion of the first housing 101 so as to adjust a height of the first housing 101, and thus the first housing 101 remains horizontal on the seabed B.

A guide protrusion 510 protrudes from an outer surface of the leg 500 in a longitudinal direction, and a guide groove 131 into which the guide protrusion 510 is inserted is installed in the second through hole 130 (see FIG. 11).

Meanwhile, as in the first embodiment, when the driven pile 200 is embedded in and fixed to the seabed B, an anchor line 300 coming out of the driven pile 200 and moving a predetermined distance through the seabed is installed in the driven pile 200.

The anchor line 300 spreads radially while being connected with the driven pile 200 and tightly pulls the driven pile 200, and thus the driven pile 200 is firmly fixed to the seabed B. A structure of the anchor line 300 is the same as that of the above-described first embodiment, and thus a detailed description will be omitted.

Figure 13:
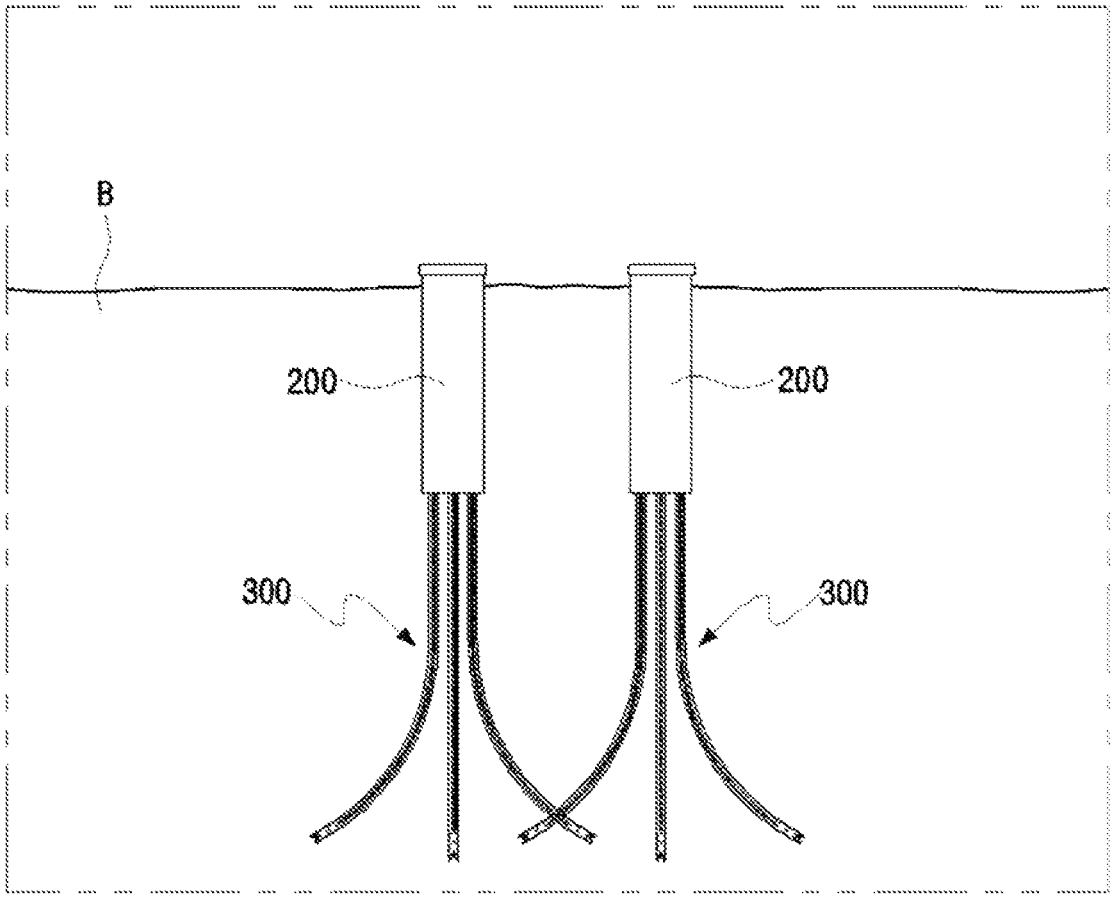
FIG. 13 is a view showing a state in which an operation of installing the driven pile according to the second embodiment of the present disclosure is completed.

FIG. 13 is a view showing a state in which an operation of installing the driven pile according to the second embodiment of the present disclosure is completed.

When an operation of installing the driven pile 200 performed on the seabed B is completely performed, as described above, the first and second housings 101 and 102 are returned to the hull 10 by the gantry crane 20, and thus a plurality of driven piles 200 are positioned in an embedded state as shown in FIG. 13.

Although not shown, a mooring line for mooring the marine structure is connected with an upper end of the driven pile 200.

While the present disclosure has been particularly described with reference to the exemplary embodiments, it should be understood by those skilled in the art that various changes in form and details may be made without departing from the spirit and scope of the present disclosure.

Therefore, the exemplary embodiments should be considered in a descriptive sense only and not for purposes of limitation. Accordingly, the scope of the present disclosure is not limited by the embodiments. The scope of the present disclosure is defined not by the detailed description of the present disclosure but by the appended claims and encompasses all modifications and equivalents that fall within the scope of the appended claims.

What is claimed is:

1. A mooring apparatus comprising:

a housing positioned on a seabed by being lowered from a hull;

a driven pile inserted into a first through hole formed in the housing, configured to come out of the housing when the housing is positioned on the seabed, and embedded in and fixed to the seabed; and an anchor line configured to come out of a guide hole formed in the driven pile and move through the seabed when the driven pile is embedded in and fixed to the seabed, wherein the anchor line comprises:

a chain accommodated in a chamber formed in the housing and having one end connected with the driven pile and the other end positioned in the guide hole;

a drill bit installed on the other end of the chain and configured to move the other end of the chain deep down to the seabed by moving through the seabed; and a driving motor configured to rotate the drill bit.

2. The mooring apparatus of claim 1, wherein the anchor line is provided with a plurality of anchor lines, and the plurality of anchor lines spread radially through the seabed.

3. The mooring apparatus of claim 1, wherein the anchor line further comprises an anchor pack installed on a rear portion of the drill bit and expanding by being filled with a hardening material when the drill bit is completely moved.

4. The mooring apparatus of claim 3, wherein a storage tank for supplying the hardening material to the anchor pack is installed in the chamber.

5. The mooring apparatus of claim 1, wherein:

a plurality of second through holes are formed in an outer circumferential portion of the housing; and a leg, which adjusts horizontality of the housing by vertically moving when the housing is positioned on the seabed, is installed in each of the second through holes.

6. The mooring apparatus of claim 5, wherein:

the leg has a guide protrusion protruding from an outer surface thereof in a longitudinal direction; and a motor that vertically moves the guide protrusion is installed on an outer circumferential portion of the housing.

7. The mooring apparatus of claim 1, wherein an actuator installed directly above the driven pile to press an upper portion of the driven pile is installed in the housing.

8. The mooring apparatus of claim 7, wherein the actuator comprises:

a cylinder fixedly installed in the housing; and a slider configured to press an upper portion of the driven pile by being vertically lowered from the cylinder.

9. A mooring apparatus comprising:

a first housing positioned on a seabed by being lowered from a hull;

a second housing coupled to an upper portion of the first housing to be vertically movable;

a driven pile inserted into a first through hole formed in the first housing and embedded in and fixed to the seabed when the first housing is positioned on the seabed; and an actuator installed in the second housing to be positioned directly above the driven pile and configured to press an upper portion of the driven pile, wherein:

a plurality of second through holes are formed in an outer circumferential portion of the first housing; and a leg, which adjusts horizontality of the first housing by vertically moving when the first housing is positioned on the seabed, is installed in each of the second through holes.

10. The mooring apparatus of claim 9, wherein:

a third through hole is formed in the center of the first housing; and a lifting shaft having an upper end coupled to the second housing is installed in the third through hole to be vertically movable.

11. The mooring apparatus of claim 10, wherein:

a first guide protrusion protrudes from an outer surface of the lifting shaft in a longitudinal direction; and a first guide groove, into which the first guide protrusion is inserted, is formed in the third through hole.

12. A mooring apparatus comprising:

a first housing positioned on a seabed by being lowered from a hull;

a second housing coupled to an upper portion of the first housing to be vertically movable;

a driven pile inserted into a first through hole formed in the first housing and embedded in and fixed to the seabed when the first housing is positioned on the seabed; and an actuator installed in the second housing to be positioned directly above the driven pile and configured to press an upper portion of the driven pile, wherein a plurality of anchor lines coming out of the driven pile to move a predetermined distance through the seabed when the driven pile is embedded in and fixed to the seabed are installed in the driven pile.

13. The mooring apparatus of claim 12, wherein the anchor line comprises:

a chain having one end connected with the driven pile; and a drill bit installed on the other end of the chain and configured to move the other end of the chain deep down to the seabed by excavating the seabed.

14. The mooring apparatus of claim 13, wherein the anchor line further comprises an anchor pack installed on a rear portion of the drill bit and expanding by being filled with a hardening material.

* * * * *